United States Patent [19]

Franklin et al.

[11] Patent Number: 4,479,583

[45] Date of Patent: Oct. 30, 1984

[54] GRAVITY FEED DISPLAY RACKS WITH MEANS FOR PRESENTATION OF UNITS OF MERCHANDISE AND FOR RELOADING

[75] Inventors: Robert P. Franklin, Lake Hopatcong; John G. Dewees, Morristown, both of N.J.

[73] Assignee: Trans-World Manufacturing Corporation, East Rutherford, N.J.

[21] Appl. No.: 353,239

[22] Filed: Mar. 1, 1982

[51] Int. Cl.[3] ..... A47F 1/00

[52] U.S. Cl. ..... 211/49 D; 211/87; 211/75; 312/42

[58] Field of Search ..... 211/490, 184, 87, 128, 211/495, 90, 52, 55, 75, 71; 312/45, 49, 42, 72, 73; 248/250, 220.3, 220.4, 221.2

[56] References Cited

U.S. PATENT DOCUMENTS

| | | | |
|---|---|---|---|
| 1,189,371 | 7/1916 | Lyons | 211/128 |
| 1,524,748 | 2/1925 | O'Connor | 211/49 D |
| 1,715,276 | 5/1929 | Burns | 211/49 D |
| 1,951,617 | 3/1934 | Kress | 211/90 |
| 2,652,154 | 9/1953 | Stevens | 211/49 D |
| 4,006,824 | 2/1977 | Snediker et al. | 312/45 X |
| 4,183,438 | 1/1980 | Huczek | 211/128 X |
| 4,310,097 | 1/1982 | Merl | 211/49 D |
| 4,387,810 | 6/1983 | Crosslen | 312/42 X |
| 4,403,700 | 9/1983 | Manlove | 211/88 |

FOREIGN PATENT DOCUMENTS

| | | | |
|---|---|---|---|
| 2009640 | 3/1979 | Fed. Rep. of Germany | 211/128 |
| 359017 | 1/1962 | Switzerland | 312/42 |

*Primary Examiner*—Ramon S. Britts

*Assistant Examiner*—Robert W. Gibson, Jr.

*Attorney, Agent, or Firm*—Ostrolenk, Faber, Gerb & Soffen

[57] ABSTRACT

A unique display rack and support structure for mounting the display rack to a support wall are disclosed. The display rack includes at least one primary receptacle for holding an item of merchandise of a predetermined size and shape in a predetermined orientation. Each display rack also includes a plurality of chutes, equal in number to the number of receptacles, each chute being associated with a different receptacle and extending above its associated receptacle and opening into its associated receptacle. Each of the chutes has a size and shape adapted to hold a plurality of items of merchandise in a stack one atop the other and in a different orientation than the predetermined orientation. The relative position of each receptacle and its associated chute is such that when a single item of merchandise is removed from the receptacle, the lowermost one of the stack of items of merchandise located in its associated chute is pulled into the receptacle by the force of gravity and is oriented in the predetermined orientation by the size and shape of the receptacle. The individual display racks may be mounted on a support wall in a shingled fashion such that the chutes, which act as storage bins, are not readily viewed by a prospective purchaser. Each display rack may be moved from a display position, wherein the chute sections are hidden from view by the display rack above it to a loading position where the chute is readily access and additional items of merchandise may be placed therein.

5 Claims, 12 Drawing Figures

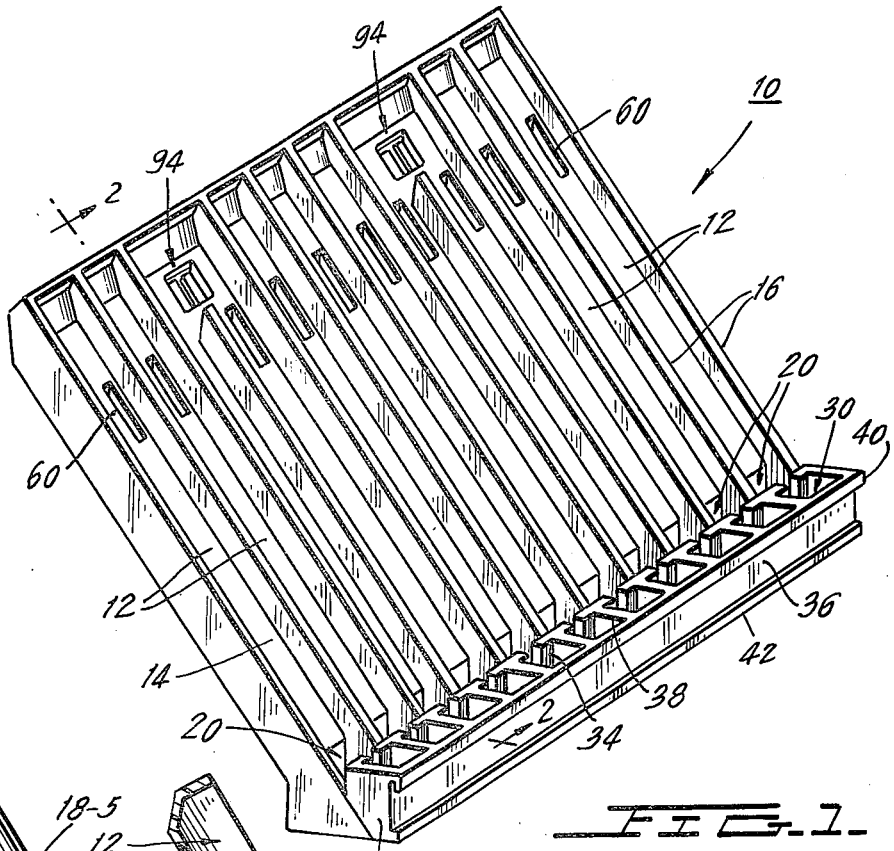
FIG. 1.
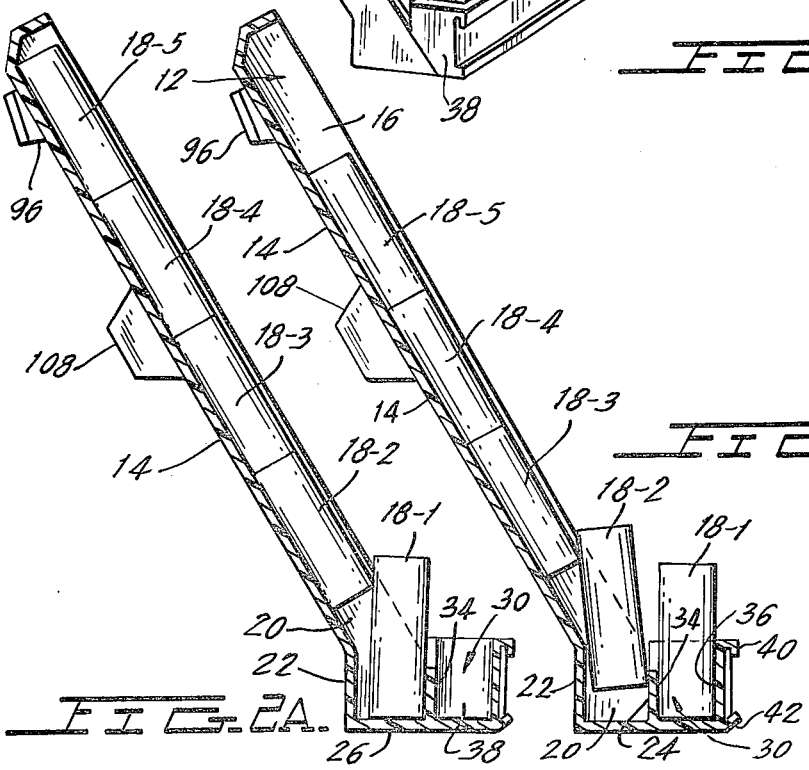
FIG. 2B.
FIG. 2A.

FIG. 5.
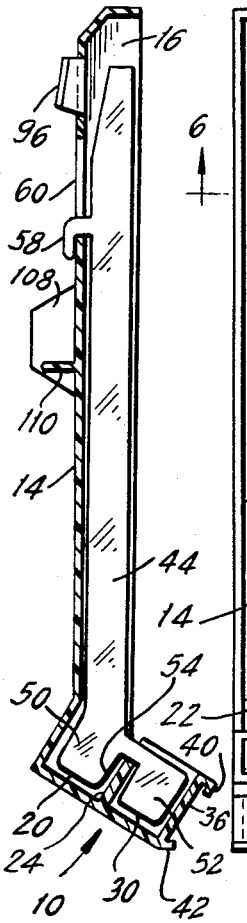
FIG. 3.
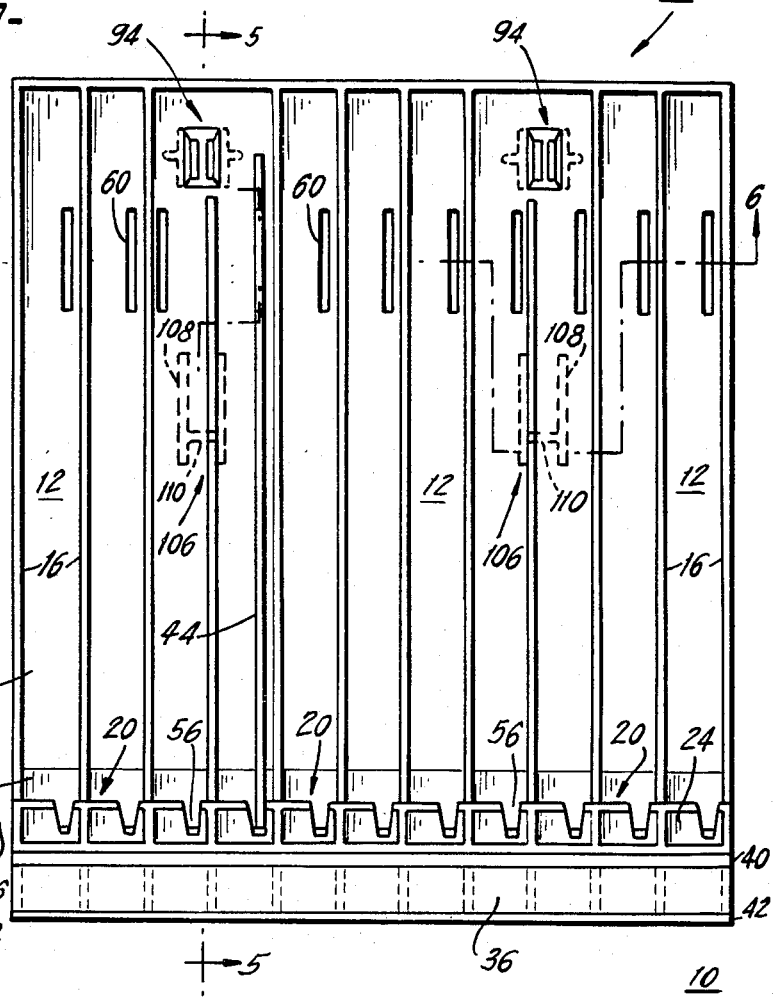
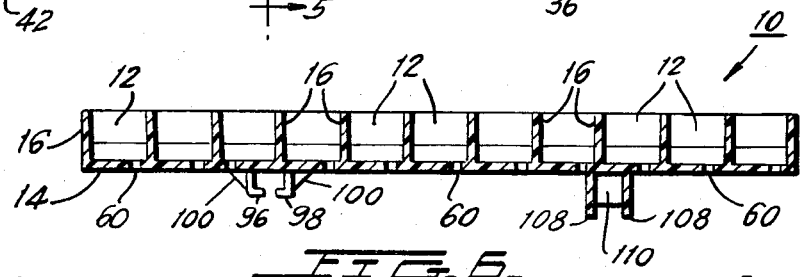
FIG. 6.
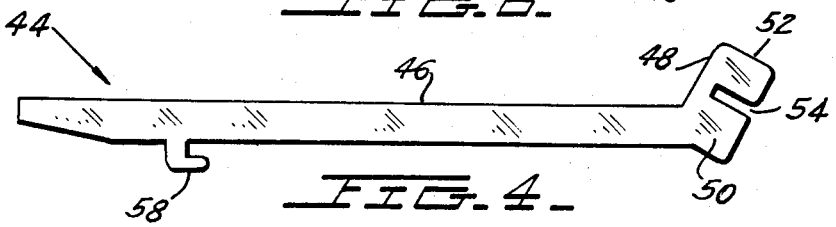
FIG. 4.

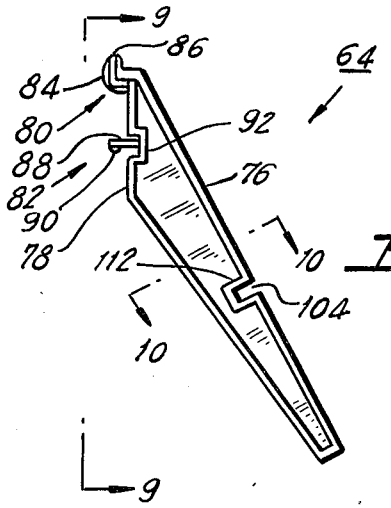
FIG. 8.
FIG. 9.
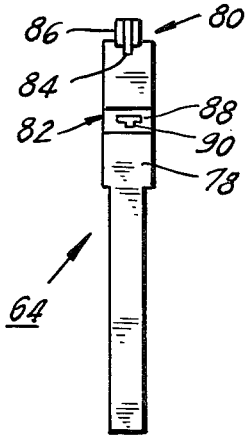
FIG. 10.
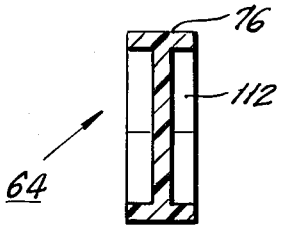
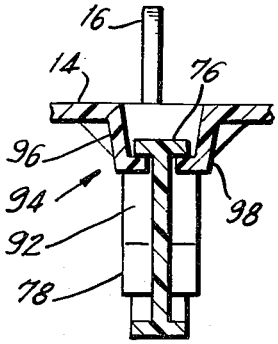
FIG. 11.

GRAVITY FEED DISPLAY RACKS WITH MEANS FOR PRESENTATION OF UNITS OF MERCHANDISE AND FOR RELOADING

BACKGROUND OF THE INVENTION

The present invention relates to display racks for articles of merchandise which may be utilized to present for display and inspection by a customer articles carried thereby and also to provide a simplified means for withdrawing an article and additional simplified means for replacing articles in the rack. The racks may also be readily reloaded.

A major object of modern merchandising displays is to maximize the utilization of wall or shelf space so as to present a large number of items in a relatively small area. In order to maximize customer appeal, the items should be presented in as neat an arrangement as possible and in a manner which makes it possible for the customer to quickly and easily locate the product or products which he or she is looking for.

While it is fairly easy to arrange a large number of small articles of merchandise, such as lipsticks or other cosmetics, in a neat and orderly manner, the merchandise can become quickly and completely disarranged as the customers go through the merchandise looking for a particular item. An arrangement which becomes helter-skelter and disorganized is unattractive and will cause the customer to become frustrated if he or she cannot quickly find what he or she is looking for. For this reason, it is highly desirable to provide a display rack which enables a customer to inspect merchandise and return it to its proper place in a simple manner.

Methods of display and presentation have been sought that make it possible for the small merchandise to be displayed with economical use of space. To a large extent, small merchandise has been encapsulated and placed on cards with mounting holes so that they could be mounted on hooks which, in turn, are supported either on a rack or pegboards, or otherwise arranged so that they at least can maintain their integrity and be, at the same time, displayed in such a way that at least the outermost unit on each hanging rod or pegboard arrangement will be visible and presented neatly.

This method of display, however, requires the forming of the card and the mounting of the item on the card and the utilization of the usually horizontally extending rod from a pegboard or rack. A more orderly arrangement can be achieved by having these individual items, such as lipsticks, mounted in racks or chutes where adjacent vertical rows are separated from each other and the bottom unit in each row may be pulled out. However, this bottom unit, unless some special provision is made on the side walls of the chute, is rather difficult to extract. The weight of the entire row is pressing on the unit and, once pulled, it is very difficult to return it. Therefore, where vertical racks have been used, there has been substantial loss or, at least, misplacement of merchandise.

SUMMARY OF THE INVENTION

The present invention contemplates the utilization of a rack consisting of a number of parallel slanted chutes where the rack is mounted on an inclined support with the forward end of the rack extending out to form an angle so that the rack as a whole and each chute forms an angle with the vertical wall or partition.

In order to obviate the problem which arises when a single unit is to be withdrawn from the bottom of the chute against the load on the unit in the chute, the present invention contemplates that the lower end of the chute be vertical and, therefore, at an angle to the remainder of the chute. Thus, as a unit is withdrawn from the bottom of the chute, the weight of the remaining units on the next unit will not only force that unit down, but will, because of the abrupt transition to a vertical receptacle at the bottom of the chute, cause that lower unit to stand up in the receptacle and the pressure of the remaining units thereon will cause it to remain standing in the receptacle. The chute itself may be arranged, if desired, so that it can be loaded only from the top or it may be arranged as a simple open front chute wherein the bottom unit is made accessible because of the abrupt transition from a slanted chute to a vertical receptacle area at the bottom of the chute.

The customer may withdraw the last unit from the receptacle without interfering in any way with the arrangement of the chute. The weight of all the remaining units on the lowest member in the chute will cause that member to drop down quickly into the vertical receptacle and the remaining elements pressing against the side of the element in the receptacle will insure that it remains standing in the receptacle. Even the last unit, with no pressure behind it when it drops down into the receptacle, will remain standing in the receptacle.

Since a customer may remove a unit, examine it more closely and then want to replace it, an additional receptacle forward of the receptacle which receives the unit directly from the chute is provided for such replacement.

In the preferred embodiment of the invention, the rack has a series of parallel chutes, each of which is provided with individual receptacles at the bottom of the chute. The individual receptacles have vertical walls including the wall which is an extension of the slanting wall of the chute itself so that the devices carried by the chute will be presented in an orderly manner in vertical condition without the need for disturbing or pushing back the contents of the chute in order to draw out the member to be inspected.

Each of the chutes may be arranged so that they will provide for units of a particular diameter, the units being arranged neatly and vertically in each of the chutes and, obviously, being somewhat smaller transversely than the chutes so that they may slide readily in the chute.

A great variation in transverse dimension is possible as related to the length of the units since it is only necessary that the units be presented neatly, and the fact that they may have some substantial clearance will not interfere with the neatness and professional quality presentation, but will provide a simplified method of delivering the units.

Removable and replaceable partitions may be provided to change the transverse dimension of the chute where a plurality of much smaller units are to be presented.

A further feature of the present invention concerns the manner in which the several racks are arranged on the vehicle support. The racks are constructed in such manner that they slant outwardly from the vertical support and may be arranged in overlapped or shingled fashion with respect to each other. The top of the second rack down in the series may extend up behind the rack which is at the top of the series with enough of the second rack extending below the top rack so that a portion of the chute is visible and the receptacle is available. Thus, where the top of each lower rack in the series extends up to about the middle of each upper rack in the series, the number of racks which can be supported on the particular wall is doubled.

As a result of this overlapping or shingled structure, the racks are supported in such manner that they may be slidable in the slanted position to make the entire rack visible clear of the rack above it so that it may be reloaded while, nevertheless, being retained in position on a support which is secured to the main support or wall.

A primary object of the present invention, therefore, is the provision of racks for displaying small objects in such manner that the racks will comprise a number of slides or chutes parallel to each other extending at an angle outwardly from the main support so that the top of the rack is closer to the support than the bottom of the rack and so that gravity will feed the units downwardly in the chute.

As a further object of the invention, at the bottom of each chute, a vertical drop is provided for a short distance into which a receptacle which will hold the unit vertically so that the unit is readily available for picking up by the customer.

As a still further object of the invention, the remaining units in the chute pressing on the unit which is dropped into the vertical receptacle will maintain the unit in the vertical receptacle in its vertical position.

As a still further object of the present invention, an additional receptacle may e provided adjacent to and preferably forward of the first receptacle so that a unit removed by a customer may be put back without the manipulation needed in order to reinsert the unit in the top of the chute.

As a still further object of the present invention, a number of such racks may be arranged in shingled relationship with respect to ech other on a support so that the upper end of any lwer rack extends up behid the rack above it with each of the racks being slidable on the support to become fully available for refill.

BRIEF DESCRIPTION OF THE DRAWINGS

For the purpose of illustrating the invention, there is shown in the drawings an embodiment which is presently preferred, it being understood, however, that the invention is not limited to the precise arrangements and instrumentalities shown.

FIG. 1 is a perspective view of a display rack constructed in accordance with the principles of the present invention.

FIGS. 2A and 2B are cross-sectional views of the rack of FIG. 1 taken along the lines 2—2 of FIG. 1.

FIG. 3 is a front view of the display rack of FIG. 1.

FIG. 4 is a side view of a divider which may be used to adjust the width of the individual chutes of the display rack of FIG. 1.

FIG. 5 is a sectional view of the display rack of FIG. 3 taken along lines 5—5 of FIG. 3.

FIG. 6 is a sectional view of the display rack of FIG. 3 taken along lines 6—6 of FIG. 3.

FIG. 8 is a side view of one of the support members illustrated in FIG. 7.

FIG. 9 is a rear view of the support member of FIG. 8 taken along lines 9—9 of FIG. 8.

FIG. 10 is a partial top view of the support member of FIG. 8 taken along lines 10—10 of FIG. 8.

FIG. 11 is a detailed view illustrating the cooperation between the support member and rack of FIG. 7 taken along lines 11—11 of FIG. 7.

DETAILED DESCRIPTION OF THE PREFERRED EMBODIMENT

Figure 7:
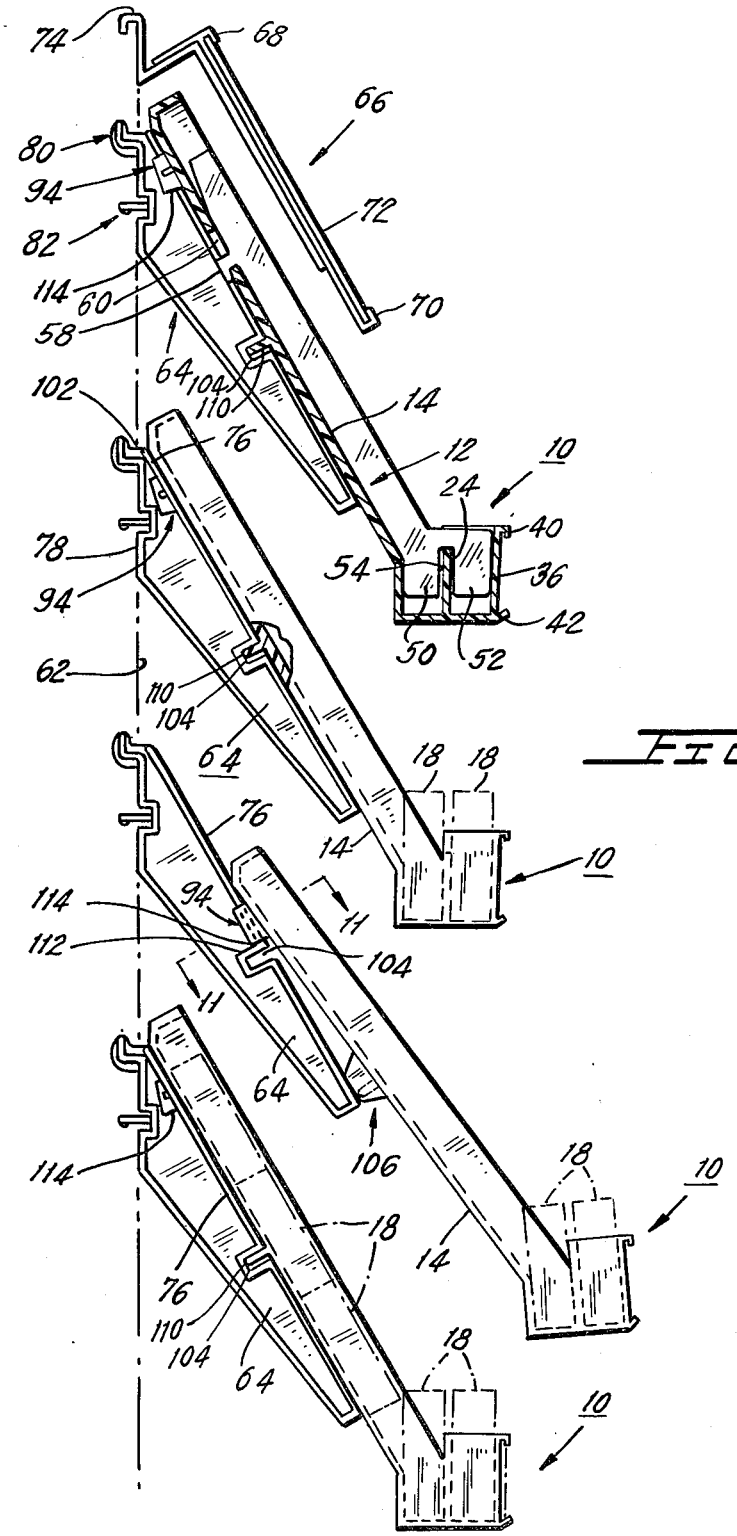
FIG. 7 is a side view illustrating the manner in which a plurality of racks may be connected to a single support wall.

Referring now to the drawings wherein like numerals indicate like elements, there is shown in FIGS. 1–3 a display rack constructed in accordance with the principles of the present invention and designated generally as 10. Display rack 10 includes a plurality of parallel extending chutes 12 each of which is defined by a rear wall 14 and a pair of side walls 16 and is adapted to hold a plurality of display items such as lipstick tubes 18 (shown in phantom in FIGS. 2A and 2B). Each chute 12 terminates in a primary receptacle 20 located at the bottom end thereof. Primary receptacle 20 is defined by a rear wall 22, a front wall 24, a bottom wall 26 and the extensions of side walls 16. As best viewed in FIGS. 2A and 2B, the bottom wall 26 of primary receptacle 20 supports the lowermost lipstick tube 18-1 in a vertical position which can easily be viewed and grabbed by a perspective purchaser. The remaining lipstick receptacles 18-2 through 18-5 are located in chute 12, one atop the other. The rear wall 14 of chute 12 is located at an angle with respect to the rear wall 22 of primary receptacle 20 such that the force of gravity causes the lower front edge of lipstick tube 18-2 to press into the rear edge of lipstick tube 18-1. This maintains tube 18-1 substantially flush against the front wall 24 of receptacle 20 and maintains tube 18-1 in the vertical position. When a perspective purchaser wishes to more closely examine the 18-1, he or she removes tube 18-1 from receptacle 20. The force of gravity will cause the remaining tubes 18-2 through 18-5 to move down towards receptacle 20 until such time as the bottom from edge of lipstick tube 18-2 contacts the front wall 24 of receptacle 20. At this point, the momentum of tube 18-2 causes it to flip towards the vertical. Lipstick tube 18-2 will continue rotating and lipstick tubes 18-3 through 18-5 will continue moving towards receptacle 20 until such time as lipstick tube 18-2 is located in the vertical position of tube 18-1 in FIG. 2A. As successive lipstick tubes 18 are removed from primary receptacle 20, gravity will pull the remaining tubes located in chute 12 towards the receptacle 20 such that successive lipstick tubes 18 are placed in the display position.

Once the potential purchaser has carefully examined the lipstick tube, he or she may decide not to purchase the same. In such a case, it is important that the prospective purchaser be able to simply replace the lipstick tube in its proper place without having to move other tubes 18. If the removed tube 18-1 had to be placed back in the primary receptacle 20, it would be necessary for the purchaser to raise the remaining lipstick tubes 18-2 through 18-5 into the chute 12 and to return the tube 18-1 to the receptacle 20. This is an awkward and difficult procedure which would not be followed by most consumers. For this reason, display rack 10 includes a plurality of supplemental receptacles 30, each of which is located in front of and associated with a different primary receptacle 20. As a result, once the purchaser has examined the lipstick tube 18-1, he or she may return it to the supplemental receptacle 30 in the manner illustrated in FIG. 2B. This is highly advantageous since it provides an easy and convenient way for the potential purchaser to turn the lipstick tube to its proper location adjacent the remaining lipstick tubes or similar color thereby maintaining a neat and organized display. Thereafter, when a different potential purchaser wishes to examine a lipstick tube of a particular color, he or she may remove the tube from the supplemental receptacle 30 without disturbing the remaining lipstick tubes 18 located in the primary receptacle 20 or the chute 12.

In the presently preferred embodiment, the supplemental receptacle 30 is defined by a bottom wall 32 which is an extension of wall 26, a rear wall 34 (which is integral with front wall 24), a front wall 36 and a respective pair of side walls 38. Front wall 36 may be provided with a pair of channel members 40, 42 which define a recess into which an advertising panel (not shown) may be inserted. The advertising panel may, for example, include information regarding the type of product being displayed, or the name of the manufacturer of the product being displayed.

The width of each chute 12 will depend on the type of merchandise to be displayed. Most lipstick tubes, for example, have a fairly standard diameter which can be accomodated between the walls 16 of chutes 12. The width of the chute 12 is preferably slight larger than the diameter of the lipstick tube 18 in order that the tube may freely slide down the chute when the bottommost tube is removed from primary receptacle 20.

In order to enable display rack 10 to be used with different types of merchandise, or different size containers of the same type of merchandise, it is preferable to provide means for adjusting the width of each chute 12. To this end, a plurality of chute dividers 44 (see FIGS. 5 and 7) may be provided. Each chute divider 44 includes a chute dividing section 46 and a receptacle dividing section 48. Receptacle dividing section 48 is divided into first and second legs 50, 52 by a slot 54. Legs 50, 52 serve to divide primary and supplemental receptacles 20, 30, respectively. The slot 54 cooperates with a reciprocal slot 56 formed in the front wall 24 of primary receptacle 20 to support the chute divider 44 in the upright position. A hook 58 located on the rear edge of channel dividing section 46 cooperates with a slot 60 formed in the rear wall 16 of chute 12 to provide further support for divider 44. The manner in which divider 44 is received in slots 56, 60 is best illustrated in FIGS. 5 and 7. In this manner, the effective width of any member of chutes 12 may be reduced as desired.

In the preferred embodiment, display racks 10 are mounted on a support wall 62 (see FIG. 7) in an overlapping manner. Support wall 62 may take the form of a pegboard or any other convenient support structure. Each display rack 10 is connected to support wall 62 by a respective pair of support members 64. As will be explained in greater detail below, each display rack 10 is connected to its respective support member 64 in a slidable manner such that the rack 10 is movable between a display position (illustrated by the first, second and fourth racks of FIG. 7) and a loading position (illustrated by the third rack of FIG. 7). In the display position, each of the racks 10 overlaps the rack 10 below it such that the majority, and preferably substantially the entirety, of the length of the chutes 12 are blocked from view. As such, consumers viewing the display will see primarily the receptacle portions of racks 10 and will be provided with a neat, orderly and attractive presentation of the merchandise (e.g., lipstick tubes 18) being displayed. In order to cover the chutes 12 of the top display rack 10, it is preferable to include a header panel 66 which extends over a substantial portion of the chutes 12 of the upper rack 10 in the manner illustrated. The extent to which header panel 66 covers the chutes 12 of the upper display 10 can be greater or less than that illustrated in FIG. 7 as desired. Header panel 66 includes a pair of channel members 68, 70 which may receive a removable information panel 72 which may carry a decorative design and/or information concerning the products being displayed. Header panel 66 is formed with a hook member 74 which attaches panel 66 to support wall 62 and orientates panel 66 in a manner which causes information panel 72 to be substantially parallel to the rear wall 14 of chutes 12.

The preferred configuration of support members 64 is best illustrated in FIGS. 8 and 9. Support member 64 is generally triangular in shape and includes a sliding support surface 76 and a rear support surface 78. A pair of hook members 80, 82 are formed on rear support surface 78 and are adapted to cooperate with openings in the pegboard support wall 62 to couple support member 64 to support wall 62. Hook member 80 preferably includes a rounded cam surface 84 which permits the vertically extending portion 86 of hook member 80 to be slipped into an opening in pegboard support wall 62 in the horizontal position and then rotated into the vertical position shown in FIG. 8. Hook member 82 preferably includes a horizontally extending tongue 88 having a boss 90 formed at the end thereof. Hook member 82 is preferably flexible in the vertical direction (as viewed in FIG. 8) to permit hook 82 to be snapped into a corresponding opening in pegboard support wall 62 as support member 64 is rotated into the position illustrated in FIG. 8. To this end, the horizontal extending tongue 88 is connected to a recessed wall 92 formed in rear support surface 78 to provide horizontally extending tongue 88 with a sufficient length to permit the same to flex in the vertical direction.

In the preferred embodiment, each display rack 10 is slidably connected to a pair of support members 64 by causing the support surface 76 to be slidably received in a pair of channel members 94 (see FIGS. 3, 5 and 6) formed in the rear surface 16 of display rack 10. Each channel member 94 includes a pair of oppositely disposed L-shaped walls 96, 98 which cooperate to define a channel into which the T-shaped sliding support surface 76 may be received. The cooperation between channel member 94 and support surface 76 is illustrated in FIG. 11. In the preferred embodiment, triangular shaped support members 100 provide extra support for walls 96, 98.

As best shown in FIG. 7, a space 102 is provided adjacent the uppermost portion of sliding support surface 76 so as to enable channel member 94 to be slipped over support surface 76. Once in this position, each display rack 10 is movable between the display and loading positions illustrated in FIG. 7. In order to maintain rack 10 in the upper display position, a recess 104 is formed in support surface 76 and cooperates with a detent member 106 formed on the rear wall 16 of display 10. As best illustrated in FIGS. 3, 5 and 6, detent members 106 include a pair of side walls 108 which are spaced apart by a distance slightly greater than the width of sliding support surface 76 and a transverse wall 110 extending perpendicular to side walls 108. When display rack 10 is to be supported in the display position, display rack 10 is slid up towards the top of support member 64 until the stop member 110 is received in the recess 104. See the first, second and fourth display racks of FIG. 7. When a given display rack 10 is to be lowered into its loading position, the bottom end of rack 10 is lifted so as to remove transverse wall 110 from recess 104 and the display rack 10 is lowered towards the bottom end of support member 64.

Rack 10 is prevented from sliding down the entire length of support surface 76 by the interaction between the rear lip 112 of recess 104 and the front edge 114 of channel member 94. Particularly, the front edge 114 of channel member 94 will abut the rear lip 112 of recess 104 so as to prevent display rack 10 from moving further down sliding support surface 76. In the preferred embodiment, the spacing between transverse wall 110 and the front edge 114 of channel member 94 is selected so that transverse wall 110 sits on the sliding support surface 76 when display rack 10 is in the loading position. As a result, once additional merchandise has been added to the chutes 12 of display rack 10, it may be easily returned to the display position by merely pushing rack 10 upwardly towards the top of support member 64 so as to cause transverse wall 110 to re-engage recess 104.

The present invention may be embodied in other specific forms without departing from the spirit or essential attributes thereof and, accordingly, reference should be made to the appended claims, rather than to the foregoing specification as indicating the scope of the invention.

What is claimed is:

1. A display apparatus, comprising:

a support wall;

a plurality of identical display racks; and a plurality of identical mounting means, each of said mounting means being associated with a different said display rack for slidably coupling its associated rack to said support wall such that each of said display racks is movable between a display position and a loading position, said display rack being closer to said wall when it is in said display position than when it is in said loading position;

each of said display racks comprising:

a plurality of primary receptacles having a size and shape adapted to hold a single item of merchandise of a predetermined size and shape in a predetermined orientation;

a plurality of chutes equal in number to the number of said primary receptacles, each said chute being associated with a different said primary receptacle and extending above its associated said primary receptacle and opening into its associated said primary receptacle, each of said chutes having a size an shape adapted to hold a plurality of said items of merchandise in a stack one atop the other and in a different orientation than said predetermined orientation; and the relative position of each said receptacle and its associated said chute being such that when said single item of merchandise is removed from said receptacle, the lowermost one of said stack of items of merchandise located in said associated chute is pulled into said receptacle by the force of gravity and is oriented in said predetermined orientation by said shape and size of receptacle.

2. The display apparatus of claim 1, wherein each said primary receptacle is defined by a bottom wall, a front wall, a rear wall and a pair of side walls, each said chute is defined by a pair of side walls and a rear wall extending therebetween, the width of each of said receptacles and the width of each of said chutes being approximately equal, the length of each said chute being several times greater than the length of its associated said receptacle and the rear wall of each said chute being oblique to the rear wall of its associated said receptacle.

3. The display rack of claims 1 or 2, further comprising a plurality of supplemental receptacles equal in number to the number of said primary receptacles, each said supplemental receptacle being associated with a different said primary receptacle and having a size and shape adapted to hold a single said item of merchandise.

4. A display apparatus, comprising:

a support wall;

a plurality of identical display racks;

a plurality of identical mounting means, each of said mounting means being associated with a different said display rack for slidably coupling its associated rack to said support wall such that each of said display racks is movable between a display position and a loading position, said display rack being closer to said wall when it is in said display position than when it is in said loading position;

each of said mounting means comprising a pair of identical support members, each of said support members having a first surface connected to said support wall and a second surface on which a said display rack is slidably mounted; and means for selectively maintaining said display racks in either said display position or said loading position, said selectively maintaining means comprising a notch formed in said second surface of each of said pair of support members and a pair of detent members extending from the rear surface of said display rack, the relative location of said detent members and said notches being such that each said detent member is located in a respective said notch when said display rack is located in said display position.

5. The display apparatus of claim 4, wherein said second means comprises a stop member formed on each of said pair of support members and a pair of abutting surfaces formed on the rear of said display rack, the relative location of said abutting surfaces and said stop members being such that said abutting surfaces and said stop members abut one another when said display rack is in said loading position.

* * * * *